US007587966B2

(12) United States Patent
Nakakado et al.

(10) Patent No.: US 7,587,966 B2
(45) Date of Patent: Sep. 15, 2009

(54) WEB PROCESSING DEVICE AND WEB PROCESSING METHOD

(75) Inventors: Masaki Nakakado, Osaka (JP); Hitoshi Satoh, Osaka (JP)

(73) Assignee: Zuiko Corporation, Osaka (JP)

( * ) Notice: Subject to any disclaimer, the term of this patent is extended or adjusted under 35 U.S.C. 154(b) by 424 days.

(21) Appl. No.: 10/597,479

(22) PCT Filed: Jan. 26, 2005

(86) PCT No.: PCT/JP2005/000960

§ 371 (c)(1),
(2), (4) Date: Jul. 27, 2006

(87) PCT Pub. No.: WO2005/075163

PCT Pub. Date: Aug. 18, 2005

(65) Prior Publication Data

US 2008/0289468 A1 Nov. 27, 2008

(30) Foreign Application Priority Data

Feb. 5, 2004 (JP) ..... 2004-029507

(51) Int. Cl.
*B26D 1/40* (2006.01)
*B65H 9/00* (2006.01)
*B65H 35/04* (2006.01)

(52) U.S. Cl. ..... 83/37; 83/343; 83/557

(58) Field of Classification Search ..... 83/343, 83/346, 733, 113, 152, 154, 156, 23, 24, 83/37, 561, 557, 13
See application file for complete search history.

(56) References Cited

U.S. PATENT DOCUMENTS 3,758,102 A * 9/1973 Munn et al. ..... 493/342
5,222,422 A * 6/1993 Benner et al. ..... 83/37

(Continued)

FOREIGN PATENT DOCUMENTS

JP 01-272803 10/1989

(Continued)

OTHER PUBLICATIONS

International Search Report for corresponding Application No. PCT/JP2005/000960 mailed May 17, 2005.

*Primary Examiner*—Stephen Choi
(74) *Attorney, Agent, or Firm*—Renner, Otto, Boisselle & Sklar LLP

(57) ABSTRACT

The present invention relates to a web processing device, comprising a plurality of pads $P_i$ revolving around a axis X1, a cutter 30 for cutting a continuous web W, and a plurality of anvils $A_i$ for receiving the cutter 30. The pads $P_i$ receive the continuous web W, and the cutter 30 cuts the continuous web W into a cut-off web W2 together with the anvil $A_i$ positioned at a first relative level L1. The pad $P_i$ revolves around the axis X1 while changing an attitude of the pad $P_i$ by turning about a line extending from the first axis toward the pad $P_i$, thereby carrying the cut-off web W2 while changing an attitude of the cut-off web W2. When the pad $P_i$ changes its attitude, the anvil $A_i$ relatively moves to a second relative level L2 so as not to hinder the pad $P_i$ changing its attitude.

11 Claims, 6 Drawing Sheets

U.S. PATENT DOCUMENTS

| | | | | |
|---|---|---|---|---|
| 6,431,038 | B2 * | 8/2002 | Couturier | 83/34 |
| 6,523,595 | B1 * | 2/2003 | Milner et al. | 156/519 |
| 6,722,494 | B2 * | 4/2004 | Nakakado | 198/792 |
| 6,758,109 | B2 * | 7/2004 | Nakakado | 74/57 |
| 2002/0125105 | A1 | 9/2002 | Nakakado | |
| 2004/0089403 | A1 * | 5/2004 | Satoh | 156/160 |

FOREIGN PATENT DOCUMENTS

| | | |
|---|---|---|
| JP | 09-294769 | 11/1997 |
| JP | 10-513086 | 12/1998 |
| JP | 11-513647 | 11/1999 |
| JP | 2002-96808 | 4/2002 |
| JP | 2003-508243 | 3/2003 |
| WO | 96/23475 | 8/1996 |
| WO | 97/144387 | 4/1997 |
| WO | 01/17473 | 3/2001 |
| WO | 01/44086 | 6/2001 |

* cited by examiner

WEB PROCESSING DEVICE AND WEB PROCESSING METHOD

TECHNICAL FIELD

The present invention relates to a web processing device and a web processing method, in which a continuous web is cut into pieces and the cut-off webs are carried while the attitude thereof is changed.

BACKGROUND ART

The first patent document, identified below, discloses a processing system, in which an elastic material is carried by pads, and the elastic material is cut between the pads while being stretched, after which the pads are rotated to change the attitude of the material.

The device of the first patent document does not have an anvil. The elastic material can be cut without using an anvil.

[First Patent Document] Japanese National Phase PCT Laid-Open Publication No. 10-513086 (WO96/23475) (FIG. 47)

The second and third patent documents, identified below, each disclose a device for cutting a continuous web while carrying the continuous web by pads to produce cut-off webs, and for widening the interval between the cut-off webs.

However, the second and third patent documents fail to disclose changing the attitude of the cut-off webs.

[Second Patent Document] Japanese National Phase PCT Laid-Open Publication No. 11-513647 (WO97/14387) (Abstract)

[Third Patent Document] Japanese National Phase PCT Laid-Open Publication No. 2003-508243 (WO01/017473) (Abstract)

DISCLOSURE OF THE INVENTION

In a conventional device, where a continuous web is cut and carried while the attitude thereof is changed by means of a single rotating unit, the cutter is received by a pad or an anvil integrated with a pad when cutting the web. With such a configuration, however, the web-cutting load acts upon the pad, thus shortening the lifetime of the pad. If an anvil for receiving the cutter is provided separately from the pad so as to prevent the web-cutting load from acting upon the pad, the anvil may hinder the change of the attitude of the pad when the pad rotates.

An object of the present invention is to provide a web processing device and a web processing method, in which a web can be cut by a cutter and an anvil and the attitude of the web can be changed by means of a single rotating unit.

A web processing device of the present invention is a web processing device, including a plurality of pads revolving (rotating) around an axis, a cutter for cutting a continuous web, and a plurality of anvils for receiving the cutter. In this processing device, the pads receive the continuous web, and the cutter cuts the continuous web into a cut-off web together with the anvil positioned at a first relative level with respect to a surface of the pad adjacent to the anvil such that the anvil can be brought into contact with the cutter. The pad revolves around the first axis while changing an attitude (orientation) of the pad by turning along the surface of the pad, thereby carrying the cut-off web while changing an attitude of the cut-off web. When the pad changes its attitude, the anvil moves to a second relative level with respect to the surface of the pad adjacent to the anvil so as not to hinder the pad changing its attitude.

Another web processing device of the present invention is a web processing device for receiving a tip portion of a continuous web at a receiving position, for carrying a cut-off web cut out from the tip portion to a hand-over position downstream of the receiving position while changing an attitude of the cut-off web, and for handing over the cut-off web to a downstream transfer device at the hand-over position, the web processing device including a rotating unit and a cutter. The rotating unit includes a plurality of pads and a plurality of anvils, which are arranged alternately around the rotating unit and which revolve (rotate) generally in a circumferential direction of the rotating unit. The cutter is capable of cutting off a tip portion of the continuous web, together with the anvil, at a cutting position downstream of the receiving position. A level of a surface of the anvil between two adjacent pads is set to be a first relative level close to a level of surfaces of the two adjacent pads at the cutting position so that the cutter, together with the anvil, can cut out a cut-off web of a predetermined length from the tip portion of the continuous web being held by the two adjacent pads. Each pad can be turned about a line extending generally in a radial direction of the rotating unit. The level of the surface of the anvil adjacent to the turning pad is set to be at a second relative level more retracted inward of the rotating unit than the first relative level with respect to the surface of the pad while the pad moves from the cutting position to the hand-over position downstream of the cutting position, so as to allow the attitude of the cut-off web to be changed by turning of the pad.

In the present invention, when cutting the web, the level of the surface of the anvil is set to the first relative level close to the level of the surface of the pad. Thus, the cutter, together with the anvil, can cut the web. The "relative level" refers to a relative level of one member or a relative position of one member along the radial direction of the rotating unit, with respect to another member. The first and second relative levels are each a relative level or a relative position along the radial direction of the rotating unit, with respect to the surface of the pad.

When the pad turns, the level of the surface of the anvil is set to the second relative level more retracted inward of the rotating unit than the level of the surface of the pad. Thus, the turn of the pad is allowed, and the attitude of the web can be changed by the turn of the pad.

Thus, while the pads rotate around a single rotating unit, to carry the web, it is possible both to cut the web and to change the attitude thereof. Therefore, it is possible to reduce the cost and the size of the processing device.

In a case where the continuous web includes an elastic member and the continuous web therefore has a contractile force along the direction in which the continuous web is carried, since the web is received onto the pad while being in the form of an uncut continuous web, it is possible to prevent the web from shrinking after being cut. Thus, since it is possible to prevent the shrinking of the web, it is easy to process the web after it is cut.

In the present invention, the relative level of the anvil with respect to the pad (the surface of the pad) or the relative level of the pad (the surface of the pad) with respect to the anvil may be changed by moving the anvil radially inward of the rotating unit with respect to the pad or by moving the pad radially outward of the rotating unit with respect to the anvil. Alternatively, the relative level may be changed by moving both of the anvil and the pad in the radial direction of the rotating unit.

The mechanism for changing the relative level of the anvil with respect to the pad or for changing the relative level of the pad with respect to the anvil may be guide means for regulating the path of revolution (rotation) of the anvil and/or the pad when the anvil or the pad revolves, or may be a driving section, such as an air cylinder, for moving the anvil and/or the pad in the radial direction of the rotating unit after the anvil and/or the pad revolve to a predetermined position. Specifically, level changing means may be provided for changing the level of the anvil and/or that of the pad at a position that is downstream of the cutting position and upstream of the hand-over position.

In a preferred embodiment of the present invention, each pad has a holding surface for holding the web, and a shape of the pad on the holding surface along a direction of an axis of the rotating unit is generally straight at the hand-over position.

If the holding surface of the pad is flat as described above, both end portions of the pad opposing each other in the direction along the axis of the rotating unit come close to the surface of the downstream transfer device after the pad turns by 90 degrees. Therefore, the handover of the web is facilitated.

A processing method of the present invention is a web processing method for receiving a tip portion of a continuous web at a receiving position, for carrying a cut-off web cut out from the tip portion to a hand-over position downstream of the receiving position while changing an attitude of the cut-off web, and for handing over the cut-off web to a downstream transfer device at the hand-over position, the method using a rotating unit and a cutter. The rotating unit used in the present method includes a plurality of pads and a plurality of anvils, which are arranged alternately around the rotating unit and which revolve generally in a circumferential direction of the rotating unit. The cutter used in the present method is capable of cutting off a tip portion of the continuous web, together with the anvil, at a cutting position downstream of the receiving position. The method comprises: a step in which the pad receives the continuous web; a step in which the cutter cuts the continuous web at the cutting position, together with the anvil positioned at a first relative level with respect to a surface of the pad adjacent to the anvil such that the anvil can be brought into contact with the cutter; a step in which the pad revolves around an axis of the rotating unit while changing an attitude of the pad by turning about a line extending generally in a radial direction of the rotating unit, thereby carrying the cut-off web while changing an attitude of the cut-off web; and a step in which, when the pad changes its attitude, the anvil adjacent to the turning pad is relatively moved to a second relative level with respect to the surface of the pad so as not to hinder the pad changing its attitude.

DESCRIPTION OF THE REFERENCE NUMERALS

Figure 1:
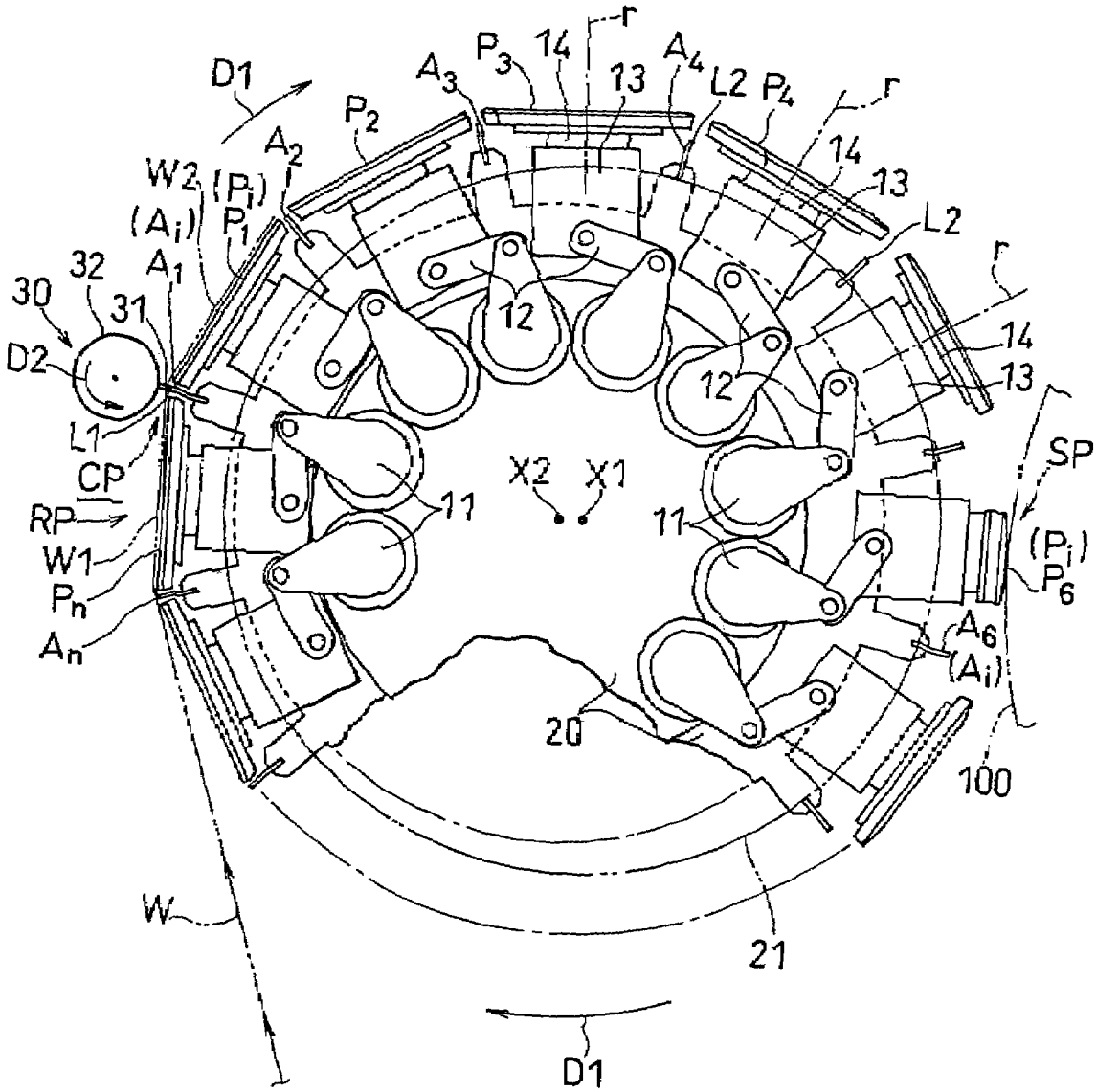
FIG. 1 is a schematic side view showing a web processing device according to an embodiment of the present invention.

20: Rotating unit
30: Cutter
200: Holding surface
$A_i$: Anvil
$P_i$: Pad
L1: First relative level
L2: Second relative level
X1: First axis
X2: Second axis
CP: Cutting position
RP: Receiving position
SP: Hand-over position
W: Continuous web
W1: Tip portion
W2: Cut-off web

BEST MODE FOR CARRYING OUT THE INVENTION

The present invention will be understood more clearly from the following description of preferred embodiments taken in conjunction with the accompanying drawings. Note however that the embodiments and the drawings are given for the purpose of mere illustration and explanation and should not be used to define the scope of the present invention. The scope of the present invention can only be defined by the appended claims. In the accompanying drawings, the same reference numerals denote the same or corresponding elements throughout several views.

An embodiment of the present invention will now be described with reference to the drawings.

FIG. 1 is a schematic side view showing a processing device according to an embodiment of the present invention.

Figure 2:
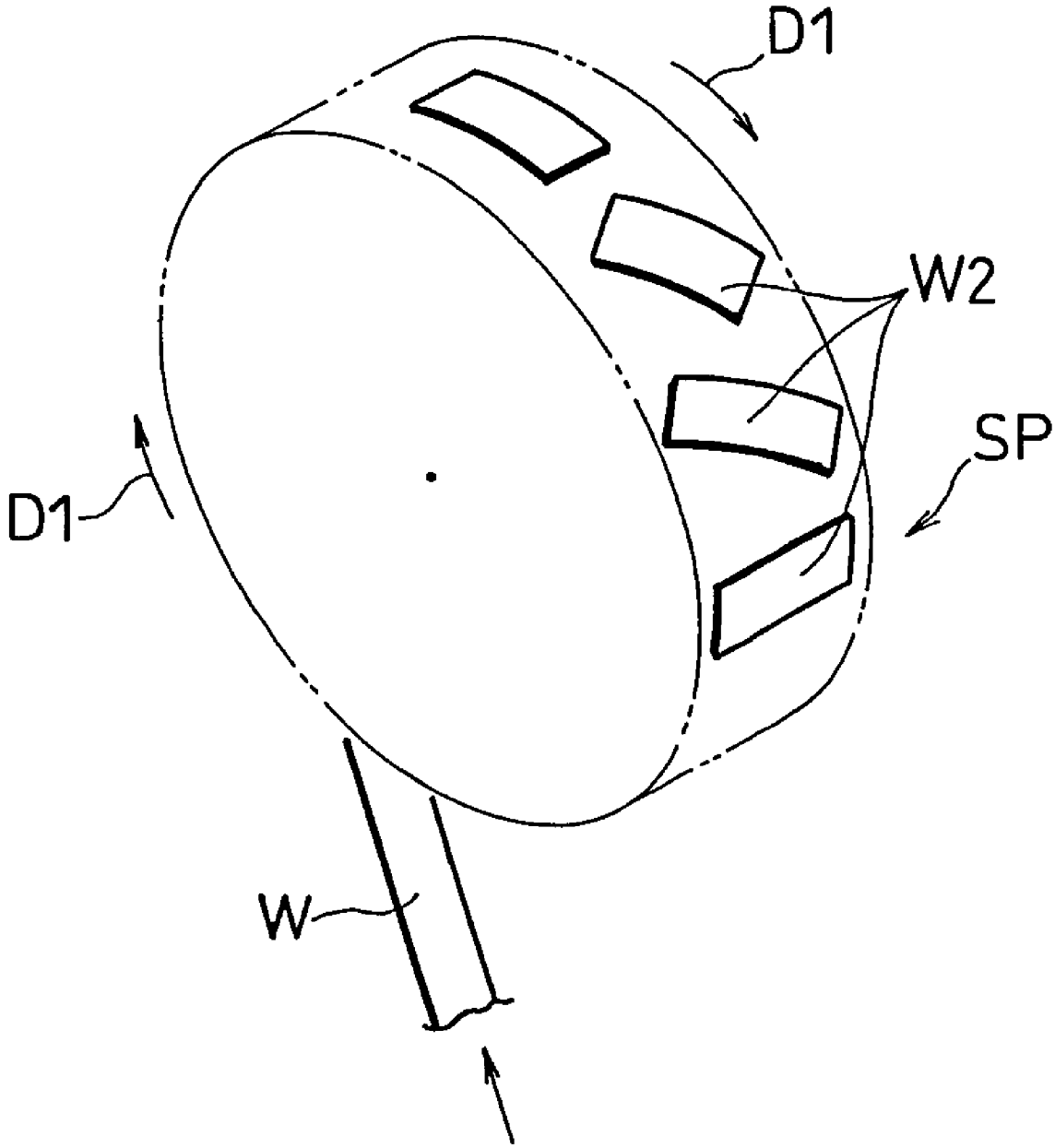
FIG. 2 is a schematic perspective view showing how the attitude of a web is changed.

As shown in FIG. 1, the present device receives a tip portion W1 of a continuous web W at the receiving position RP, and cuts the continuous web W at the cutting position CP downstream of the receiving position RP. Moreover, as shown in FIG. 2, the present device carries cut-off webs W2, produced by cutting the continuous web W, to the hand-over position SP downstream of the cutting position CP while changing the attitude of the cut-off webs W2. Then, the present device hands over the cut-off web W2 to a transfer device 100, located downstream of FIG. 1, at the hand-over position SP.

As shown in FIG. 1, the present device includes a plurality of pads $P_i$, a plurality of anvils (blade-receiving beds) $A_i$, and a cutter 30.

The cutter 30 includes at least one blade 31 fixed to a cutter roll 32, for example. A plurality of blades 31 may be provided on the cutter 30.

The anvils $A_i$ are members for receiving the blades 31, and may be fixed around a rotating unit 20. A plurality of anvils $A_i$ may be provided around the rotating unit 20 equiangularly (at an equal angular pitch).

The rotating unit 20 rotates in the first direction D1. The cutter 30 rotates in the second direction D2, opposite to the first direction D1, in synchronism with the rotating unit 20. Thus, the rotating unit 20 and the cutter roll 32 rotate so that the blade 31 hits an anvil $A_i$ when the anvil $A_i$ reaches the cutting position CP. Each time the cutter roll 32 rotates by a predetermined angle (e.g., 360 degrees, i.e., one rotation), the blade 31 hits the anvil $A_i$ ($A_1$) at the cutting position CP, whereby the tip portion W1 of the continuous web W is cut off one after another, thus producing the cut-off webs W2.

The pads $P_i$ and the anvils $A_i$ alternate with each other circumferentially around the rotating unit 20, and rotate together with the rotating unit 20 in the circumferential direction of the rotating unit 20. The pads $P_i$ rotate generally about the first axis X1 to be described later, for example. The anvils $A_i$ rotate in the first direction D1 generally about the second axis X2, which is parallel to the first axis X1 but is shifted from the first axis X1. The second axis X2 may be the center of rotation of the rotating unit 20, for example.

The pads $P_i$ may hold the tip portion W1 of the continuous web W or the cut-off web W2 by sucking onto the web, or by hooking the web W by needles, or the like, provided on the surface of the pads $P_i$. For example, where the webs W, W1 and W2 are sucked onto the pads $P_i$ by vacuum, a plurality of suction holes (not shown) may be provided on the surface of the pads $P_i$.

After the pad $P_i$ receives the tip portion W1 of the continuous web W at the receiving position RP, the pad $P_i$ rotates in the first direction D1 from the receiving position RP. After being received, the tip portion W1 of the continuous web W is cut off at the cutting position CP by means of the anvil $A_i$ and the cutter 30 in cooperation, thereby producing the cut-off web W2. After the cutting, the cut-off web W2 on the pad $P_i$ is carried to the hand-over position SP. At the hand-over position SP, air may be blown through the suction holes of the pad $P_i$ so that the cut-off web W2 can easily be released from the pad $P_i$.

A plurality of first arms 11 are fixed to the rotating unit 20 in a radial pattern. A second arm 12 is provided at the tip portion of each first arm 11 so that the second arm 12 can rotate with respect to the first arm 11. A pad frame 13 is attached to the tip of the second arm 12. As the rotating unit 20 rotates, the first and second arms 11 and 12 follow the rotation of the rotating unit 20, and the pad frames 13 rotate in the first direction D1 together with the rotating unit 20.

Guide means 21 for regulating the circular path of the pads $P_i$ is provided at the position indicated by a two-dot chain line around the rotating unit 20. The guide means 21 guides the pad frames 13 along a circle centered about the first axis X1. Therefore, as the pad frames 13 are rotated via the arms 11 and 12 following the rotation of the rotating unit 20, the pad frames 13 are rotated about the first axis X1 while being guided by the guide means 21. Thus, the pads $P_i$ rotating about the first axis X1 and the anvils $A_i$ rotating about the second axis X2 are in circular motion along different paths.

The radius of rotation of the pads $P_i$ is larger than that of the anvils $A_i$. The first axis X1, being the center of rotation of the pads $P_i$, is situated nearer the hand-over position SP than the second axis X2, being the center of rotation of the anvils $A_i$. Therefore, the relative level of a pad $P_i$ with respect to its adjacent anvil $A_i$ changes outwardly with respect to the rotating unit 20 while moving from the cutting position CP to the hand-over position SP. The relative level of a pad $P_i$ with respect to its adjacent anvil $A_i$ changes inward of the rotating unit 20 while the pad $P_i$ moves from the hand-over position SP to the cutting position CP.

The change in the relative level of the pad $P_i$ with respect to its adjacent anvil $A_i$ in the radial direction can be realized not only by using the guide means 21 but also by moving the pad $P_i$ in the radial direction of the rotating unit 20 by means of an air cylinder or a motor, for example.

Each pad $P_i$ is rotatably fitted into a pad frame 13 via a turning section 14. Each pad $P_i$ can be pivoted about the normal r generally perpendicular to the surface of the pad $P_i$ (the normal r extending generally along the radial direction with respect to the first axis X1 (the radial direction of the circular path for the rotation of the pads)), i.e., a line extending generally in the radial direction of the rotating unit 20. Thus, it is possible to change the attitude of the cut-off web W2.

Figure 3:
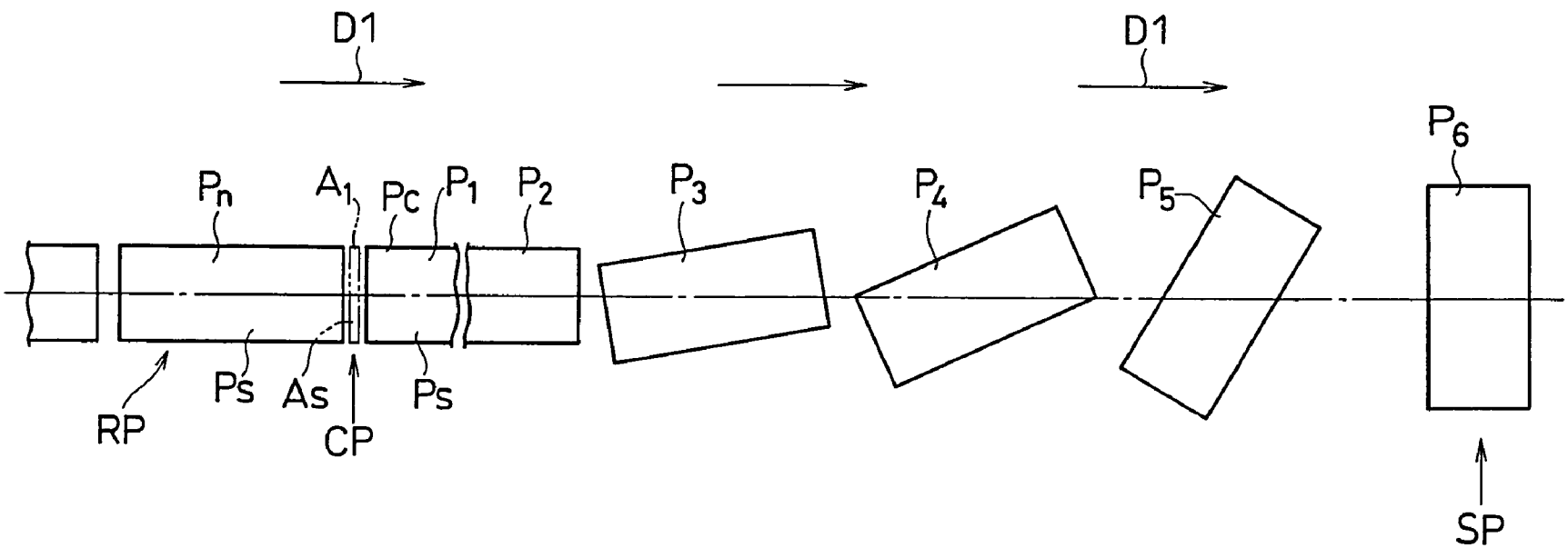
FIG. 3 is a development view showing an attitude of pads.

FIG. 3 is a schematic development view showing pivoting (turning) motion of the pad $P_i$ during moving from the receiving position RP to the hand-over position SP.

As shown in FIG. 3, the pad $P_i$ starts pivoting to change its attitude after passing through the cutting position CP and after the anvil $A_i$ shifts the relative level inward. The pad $P_i$ pivots by a predetermined angle (e.g., 90 degrees) by the time when the pad $P_i$ reaches the hand-over position SP. Therefore, the cut-off web W2 on the pad $P_i$ is handed over to the downstream transfer device 100 (FIG. 1) in such a posture (attitude) that it has turned by the predetermined angle. While the pad $P_i$ moves (returns) from the hand-over position SP to the receiving position RP shown in FIG. 1, the pad $P_i$ pivots further by a predetermined angle (e.g., 90 degrees) into such an attitude that the pad $P_i$ can received the continuous web W.

The pads $P_i$ revolve about the first axis X1 without pivoting, i.e., while maintaining the same attitude, at the receiving position RP, the cutting position CP and the hand-over position SP.

Figure 4A:
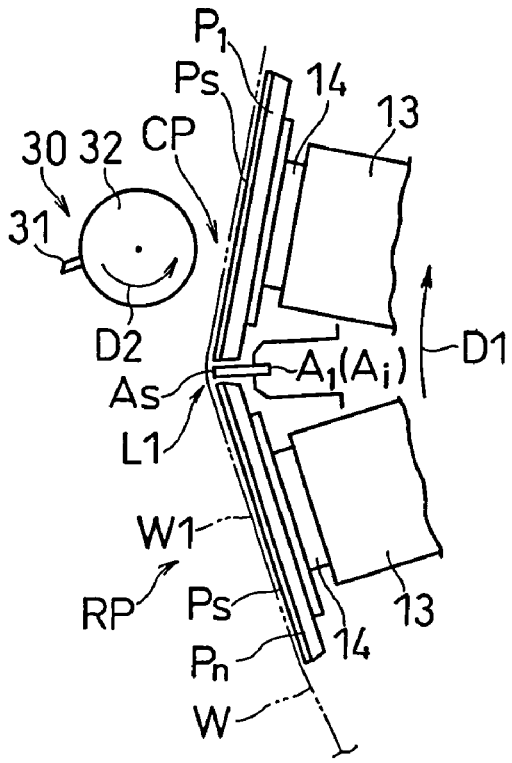
FIGS. 4(*a*), 4(*b*) and 4(*c*) are partial side views of the processing device each showing how relative levels of anvils and pads change.
Figure 4B:
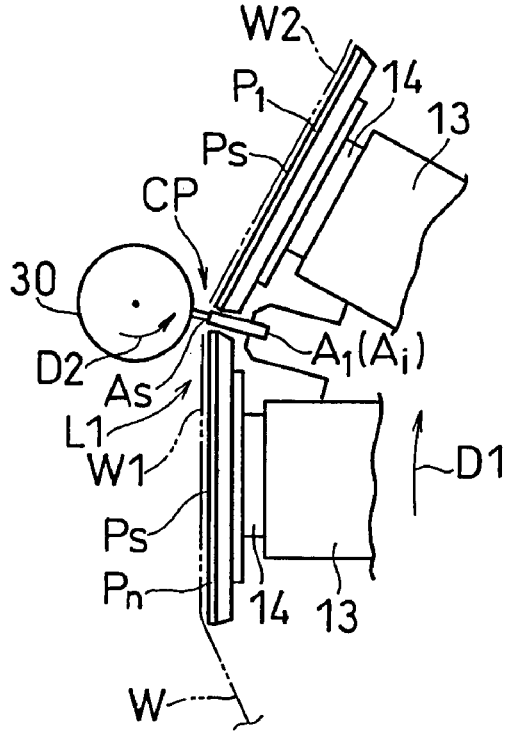
Figure 4C:
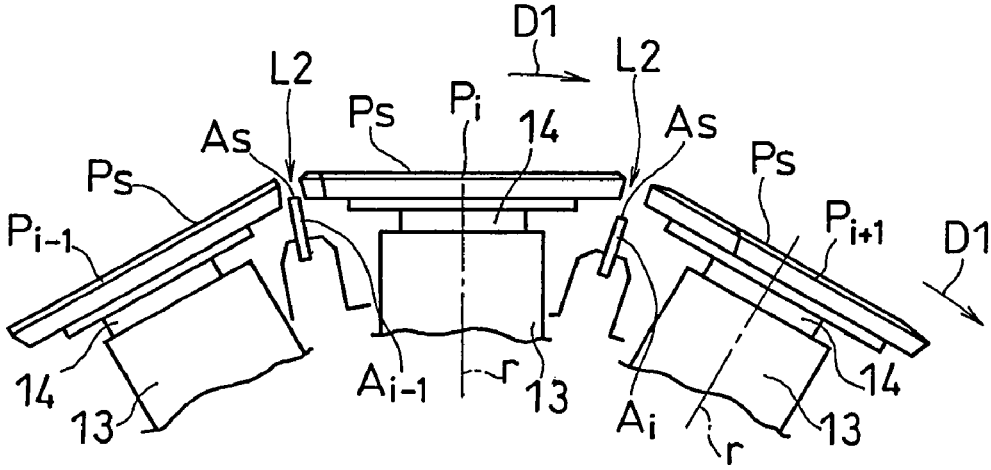

When the cutter 30 cuts the web W, the level of the surface As of the anvil $A_i$ is positioned at the first relative level L1 close to the level of the surface Ps of the pad $P_i$, as shown in FIGS. 4(*a*) and 4(*b*), thereby allowing the web W to be cut by the blade 31. At the cutting position CP, etc., the pad $P_i$ cannot pivot because a pivoting pad at this position would be in contact with the anvil $A_i$. The distance from the first axis X1 to the surface As of the anvil $A_i$ at the first relative level L1 may be set to be generally equal to the distance from the first axis X1 to the surface Ps of the pad $P_i$.

While moving from the cutting position CP to the hand-over position SP, the level of the surface As of the anvil $A_i$ is changed to the second relative level L2, i.e., retracted, inward of the rotating unit 20 (FIG. 1) with respect to the surface Ps of the pad $P_i$, as shown in FIG. 4(*c*), so that the corner portion Pc of the pivoting pad $P_i$ of FIG. 3 will not be in contact with the anvil $A_i$. Such a change in the relative level allows the pads $P_i$ to pivot. The distance from the first axis X1 to the surface As of the anvil $A_i$ at the second relative level L2 may be set to be smaller than the distance from the first axis X1 to the surface Ps of the pad $P_i$.

That is, while moving from the cutting position CP to the hand-over position SP, the pad $P_i$ of FIG. 1 is relatively moved outward with respect to the level of the surface As of the adjacent anvil $A_i$. Thus, the surface As of the anvil $A_i$ is relatively moved to the second relative level L2, which is retracted inward with respect to the surface Ps of the adjacent pad $P_i$, thereby allowing the pad $P_i$ to pivot about the normal r of the pad $P_i$.

While moving from the hand-over position SP to around the receiving position RP or the cutting position CP, the surface Ps of the pad $P_i$ is relatively moved inward of the rotating unit 20 with respect to the surface As of the adjacent anvil $A_i$ to be at the first relative level L1. Therefore, at the cutting position CP, the surface As of the anvil $A_i$ returns to the first relative level L1 close to the level of the surface Ps of the pad $P_i$, whereby the cut-off web W2 can be cut out from the continuous web W by means of the cutter 30 together with the anvil $A_i$.

The change of the relative levels L1 and L2 may be realized by shifting the level of the anvil $A_i$ or shifting both the level of the anvil $A_i$ and that of the pad $P_i$, instead of by shifting the level of the pad $P_i$ in the radial direction of the rotating unit 20 as described above.

Now, an example of the guide means 21, etc., will be described with reference to a transverse sectional view of FIG. 5(*a*).

Figure 5A:
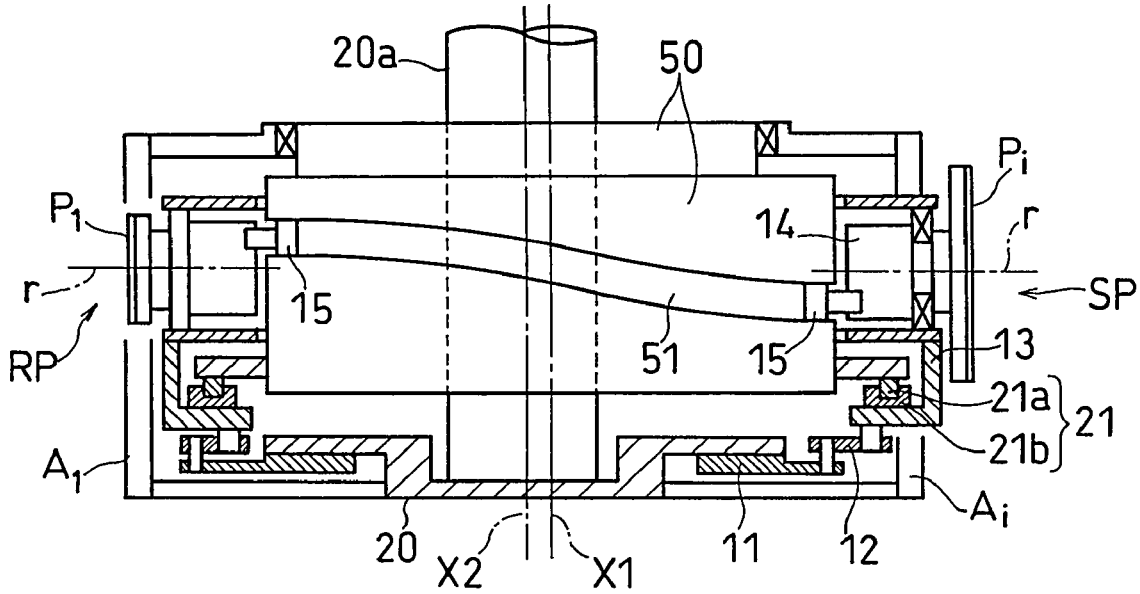
FIG. 5(*a*) is a schematic transverse sectional view showing the processing device at the receiving position and the hand-over position, FIG. 5(*b*) is a development view showing an example of how the attitude of the web is changed, and FIG. 5(*c*) is a development view showing another example of how the attitude of the web is changed.
Figure 5B:
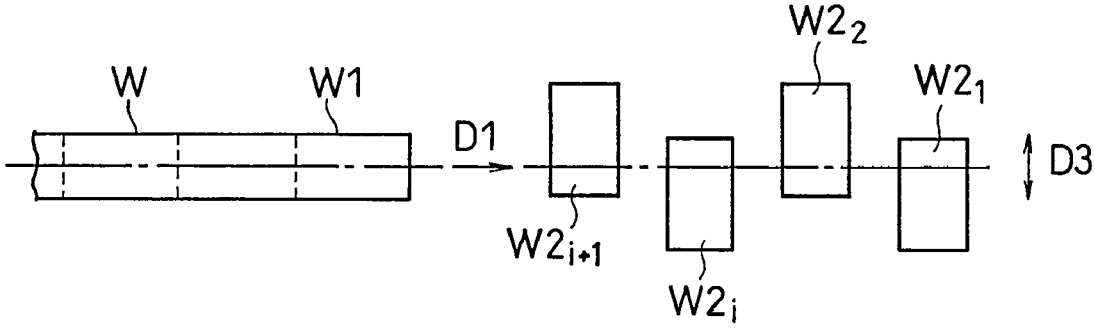
Figure 5C:
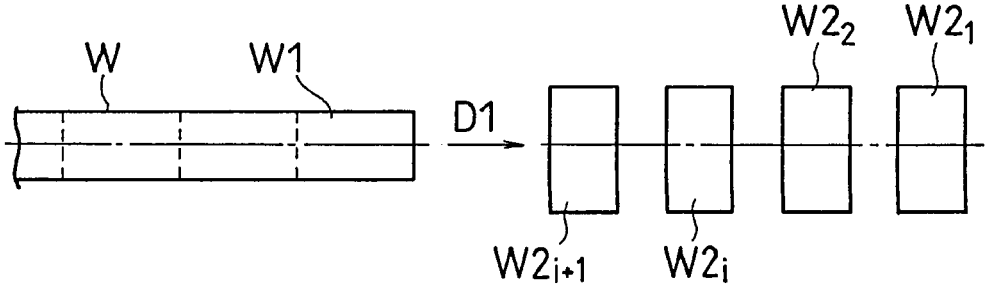

As shown in FIG. 5(*a*), the guide means 21 may include a ridge portion 21*a* fixed to a stationary cylinder section 50, and a groove member 21*b* fitted around the ridge portion 21*a*. The pad frame 13 is connected to the second arm 12 and the groove member 21*b*.

The stationary cylinder section 50 is fixed to the frame of the installation (not shown), and rotatably supports a rotary shaft 20*a* of the rotating unit 20. The center of the stationary cylinder section 50 and the guide means 21 is the first axis X1, and the center of rotation of the rotating unit 20 is the second axis X2. Thus, the pad frames 13 rotate about the first axis X1, which is eccentric to the second axis X2.

The arrangement of the ridge portion 21*a* and the groove member 21*b* may be reversed. That is, the groove member 21*b* may be fixed to the stationary cylinder section 50, and the pad frame 13 may be connected to the ridge portion 21*a*.

Now, pivoting means for pivoting the pads $P_i$ will be described.

A cam groove 51 is formed on the outer peripheral surface of the stationary cylinder section 50. A roller 15 provided on the pivoting section 14 of each pad $P_i$ is fitted in the cam groove 51. As the pad $P_i$ rotates about the first axis X1 from the receiving position RP to the hand-over position SP, the roller 15 moves in the direction of the axis X1 along the cam groove 51, whereby the pivoting section 14 and the pad $P_i$ pivot by about 90 degrees. Thus, the attitude of the cut-off web W2 on the pad $P_i$ is changed.

A structure as disclosed in Japanese Laid-Open Patent Publication No. 01-272803 or Japanese Laid-Open Patent Publication No. 2002-96808 may be employed for the pivoting means.

Now, the operation of the present device will be described.

As shown in FIG. 4(*a*), the tip portion W1 of the supplied continuous web W is held by the pad $P_i$ at the receiving position RP, and carried in the downstream D1 direction by the pad $P_i$, which revolves in the first direction D1. As the tip portion W1 of the web W passes through the cutting position CP, as shown in FIG. 4(*b*), the blade 31 of the cutter 30 hits the surface As of the anvil $A_i$ at the first relative level L1 at the cutting position CP. Thus, the blade 31 cuts the continuous web W to cut off the tip portion W1 of the web. Thus, the cut-off web W2 is produced.

After the cutting, as shown in FIG. 4(*c*), the surface Ps of the pad $P_i$ is gradually moved outward of the rotating unit 20 with respect to the surface As of the adjacent anvil $A_i$ while being revolved in the first direction D1. In other words, the level of the anvil $A_i$ is relatively moved toward below the pad $P_i$. Thus, the pad $P_i$ can pivot about the normal r. In such a state, the pad $P_i$ starts pivoting, and by the time when the pad $P_i$ reaches the hand-over position SP, the attitude of the pad $P_i$ is changed, and, as a result, the attitude of the cut-off web W2 on the pad $P_i$ is changed.

At the hand-over position SP, the pad $P_i$ of FIG. 1 releases the hold of the cut-off web W2, thereby handing over the cut-off web W, whose attitude has been changed, to the downstream transfer device 100. The transfer device 100 may include a pad for sucking the cut-off web W2 thereonto, or may carry the cut-off web W2 on a conveyer. Then, the pad $P_i$, while being further revolved in the first direction D1, is relatively moved with respect to the adjacent anvil $A_i$ inward of the rotating unit 20 and is further pivoted, thereby returning back to its original attitude by the time when the pad $P_i$ reaches the receiving position RP.

Thus, with the present processing device, at the time of cutting the web, the blade 31 can hit the surface As of the anvil $A_i$ so as to cut the web W, and, at the time of changing the attitude of the cut-off web, the pad $P_i$ becomes capable of pivoting. Thus, with the single rotating unit 20, it is possible both to cut the web W and to change the attitude thereof. Therefore, it is possible to reduce the cost and the size of the processing device.

If the pads $P_i$ and the anvils $A_i$ are moved in circular motion about the two different axes X1 and X2, respectively, it is easy to change the relative levels of the pad $P_i$ and the anvil $A_i$.

FIGS. 5(*b*) and 5(*c*) each show an arrangement of the cut-off webs W2.

The attitude of the pad $P_i$ may be changed so that the cut-off webs $W2_i$ are arranged in a staggered pattern, as shown in FIG. 5(*b*). In this case, the pads $P_i$ are moved alternately in the first direction of the width direction D3 (the downward direction in FIG. 5(*b*)) and in the second direction (the upward direction in FIG. 5(*b*)) opposite to the first direction, whereby the cut-off webs $W2_i$ and $W2_{i+1}$ are arranged in a staggered pattern. Thus, the cut-off web $W2_i$ is shifted in the first direction of the width direction D3, and the cut-off web $W2_{i+1}$ adjacent to the cut-off web $W2_i$ is shifted in the second direction of the width direction D3.

The webs $W2_i$ may be aligned in a single line as shown in FIG. 5(*c*).

Figure 6:
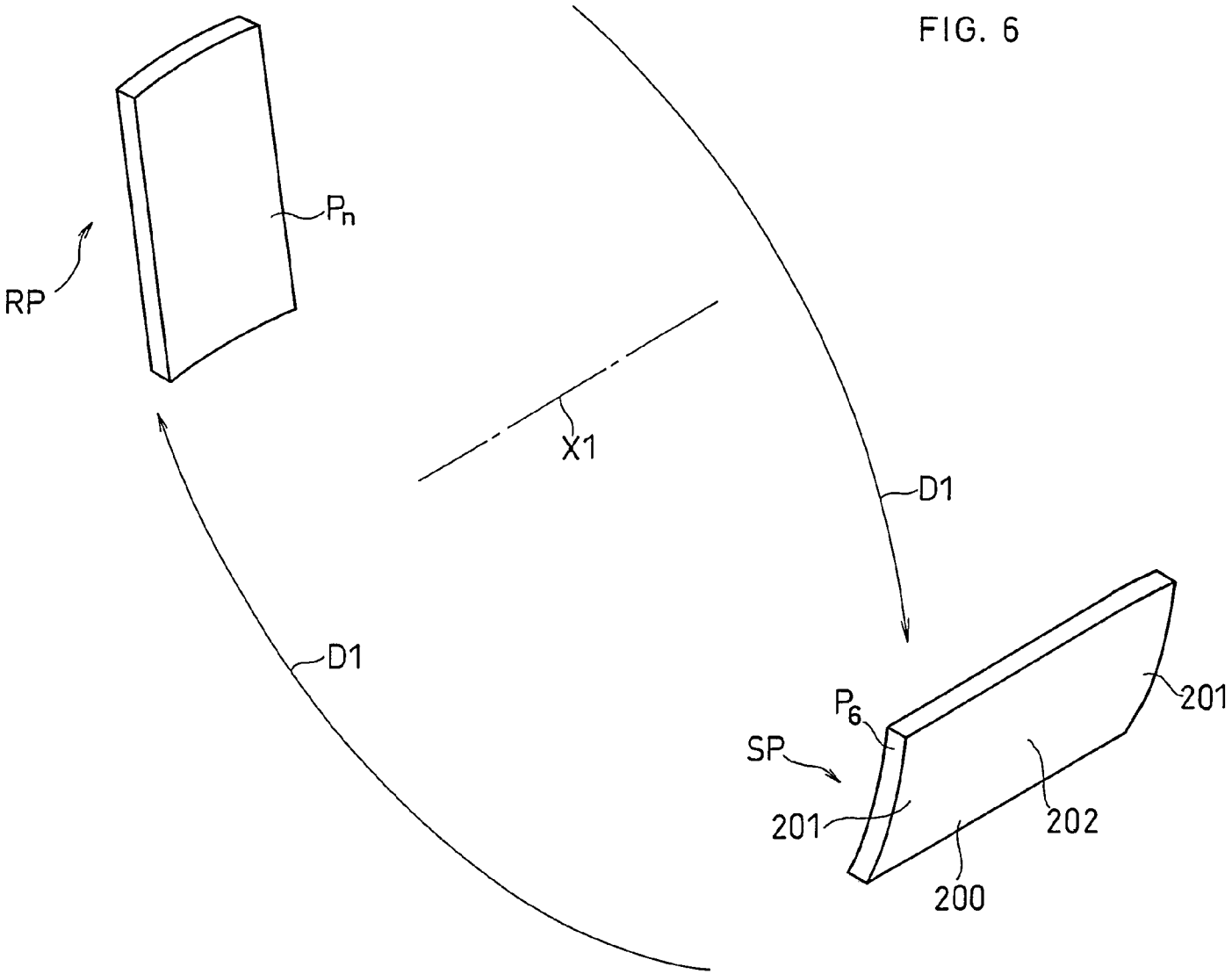
FIG. 6 is a schematic perspective view showing the attitude of the pad at the receiving position and that at the hand-over position.

FIG. 6 is a schematic perspective view showing the pad $P_i$.

Each pad $P_i$ has a holding surface 200 for holding the cut-off web W2. The shape of the holding surface 200 along the circumferential direction D1 of the rotating unit 20 at the hand-over position SP is outwardly-protruding curved. The shape of the holding surface 200 along the direction of the first axis X1 of the rotating unit 20 at the hand-over position SP is generally straight. Thus, the holding surface 200 appears generally as a straight line in the cross section of the pad $P_i$ taken along a line parallel to the first axis X1 at the hand-over position SP.

If tapered surfaces are formed at end portions 201 opposing each other in the direction along the first axis X1 of the holding surface 200 at the hand-over position SP, the opposite end portions 201 will be positioned slightly away from the downstream transfer device 100. Therefore, in this case, when the opposite end portions of the cut-off web W2 held on the holding surface 200 are sucked and received by the transfer device 100, the opposite end portions of the cut-off web W2 would be more likely to get creased. In contrast, if the shape of the holding surface 200 along the direction of the first axis X1 is straight as in the present embodiment, the opposite end portions 201 of the holding surface 200 come close to the pad of the transfer device as is a central portion 202 of the holding surface 200. Therefore, the handover of the cut-off web W2 is facilitated, and the opposite end portions of the cut-off web W2 are less likely to get creased, etc.

At the receiving position RP, the shape of the holding surface 200 along the circumferential direction D1 of the rotating unit 20 is straight. As shown in FIG. 1, with the present device, the continuous web W before being cut is received by the pad $P_i$. Therefore, the continuous web W can be received even if the shape of the holding surface 200 is straight.

While a preferred embodiment of the present invention has been described above with reference to the drawings, obvious variations and modifications will readily occur to those skilled in the art upon reading the present specification.

For example, at the cutting position, the level of the surface of the anvil may be protruding outward of the rotating unit with respect to the level of the surface of the pad, may be equal to the level of the surface of the pad, or may be slightly retracted from the level of the surface of the pad.

The surface of the pad may be an arc-shaped curved surface.

The path of rotation of the pad need not necessarily be circular, but may be elliptic or of any other suitable shape.

The pads or the anvils need not necessarily rotate about a fixed position such as the axis X1 or X2.

The pad need not necessarily pivot about the normal, but may pivot around another line intersecting the surface of the pad.

Thus, such variations and modifications shall fall within the scope of the present invention as defined by the appended claims.

INDUSTRIAL APPLICABILITY

The present invention is applicable to a processing device for processing a web, e.g., disposable worn articles such as sanitary products, disposable underpants and disposable diapers, medical materials such as wound dressings, building materials such as heat-insulating materials, etc.

The invention claimed is:

1. A web processing device, comprising a plurality of pads revolving around a first axis, a cutter for cutting a continuous web, and a plurality of anvils for receiving the cutter, wherein:

the pads receive the continuous web;

the cutter cuts the continuous web into a cut-off web together with the anvil positioned at a first relative level with respect to a surface of the pad adjacent to the anvil such that the anvil is brought into contact with the cutter;

the pad revolves around the first axis while changing an attitude of the pad by turning about a line extending from the first axis toward the pad, thereby carrying the cut-off web while changing an attitude of the cut-off web; and when the pad changes its attitude, the anvil moves to a second relative level, different from the first relative level, with respect to the surface of the pad adjacent to the anvil so as not to hinder the pad changing its attitude.

2. A web processing device according to claim 1, wherein:

each pad revolves generally about the first axis and each anvil revolves generally about a second axis;

the first axis and the second axis are generally parallel to each other and are out of alignment with each other; and the anvil at the second relative level is positioned inward closer to the first axis than the anvil at the first relative level.

3. A web processing device according to claim 1, wherein each pad has a holding surface for holding the web, and a shape of the holding surface along a direction of the first axis is generally straight at a hand-over position.

4. A web processing device for receiving a tip portion of a continuous web at a receiving position, for carrying a cut-off web cut out from the tip portion to a hand-over position downstream of the receiving position while changing an attitude of the cut-off web, and for handing over the cut-off web to a downstream transfer device at the hand-over position, the web processing device comprising a rotating unit and a cutter, wherein:

the rotating unit includes a plurality of pads and a plurality of anvils, which are arranged alternately around the rotating unit and which revolve generally in a circumferential direction of the rotating unit;

the cutter is capable of cutting off a tip portion of the continuous web, together with the anvil, at a cutting position downstream of the receiving position;

a level of a surface of the anvil between two adjacent pads is set to be a first relative level close to a level of surfaces of the two adjacent pads at the cutting position so that the cutter, together with the anvil, can cut out a cut-off web of a predetermined length from the tip portion of the continuous web being held by the two adjacent pads;

each pad is turned about a line extending generally in a radial direction of the rotating unit; and the level of the surface of the anvil adjacent to the turning pad is set to be at a second relative level more retracted inward of the rotating unit than the first relative level with respect to the surface of the pad while the pad moves from the cutting position to the hand-over position downstream of the cutting position, so as to allow the attitude of the cut-off web to be changed by turning of the pad.

5. A web processing device according to claim 4, wherein:

each pad revolves generally about a first axis of the rotating unit, and each anvil revolves generally about a second axis of the rotating unit;

the first axis and the second axis are generally parallel to each other and are out of alignment with each other; and the anvil at the second relative level is positioned inward closer to the first axis than the anvil at the first relative level.

6. A web processing device according to claim 4, wherein each pad has a holding surface for holding the web, and a shape of the pad on the holding surface along a direction of an axis of the rotating unit is generally straight at the hand-over position.

7. A web processing method for receiving a tip portion of a continuous web at a receiving position, for carrying a cut-off web cut out from the tip portion to a hand-over position downstream of the receiving position while changing an attitude of the cut-off web, and for handing over the cut-off web to a downstream transfer device at the hand-over position, the method using a rotating unit and a cutter, wherein the rotating unit includes a plurality of pads and a plurality of anvils, which are arranged alternately around the rotating unit and which revolve generally in a circumferential direction of the rotating unit, and the cutter is capable of cutting off a tip portion of the continuous web, together with the anvil, at a cutting position downstream of the receiving position, the method comprising:

a step in which the pad receives the continuous web;

a step in which the cutter cuts the continuous web at the cutting position, together with the anvil positioned at a first relative level with respect to a surface of the pad adjacent to the anvil such that the anvil is brought into contact with the cutter;

a step in which the pad revolves around an axis of the rotating unit while changing an attitude of the pad by turning about a line extending generally in a radial direction of the rotating unit, thereby carrying the cut-off web while changing an attitude of the cut-off web; and a step in which, when the pad changes its attitude, the anvil adjacent to the turning pad is relatively moved to a second relative level, different from the first relative level, with respect to the surface of the pad so as not to hinder the pad changing its attitude.

8. A web processing device according to claim 5, wherein:

the second axis is set so as to be closer to the cutting position than the first axis, and the first axis is set so as to be closer to the hand-over position than the second axis.

9. A web processing device according to claim 8, wherein:

the first axis and the second axis remain set relative to each other.

10. A web processing device method according to claim 7, wherein:

an axis around which the anvils revolve is set so as to be closer to the cutting position than the axis around which the pads revolve, and the axis around which the pads revolve is set so as to be closer to the hand-over position than the axis around which the anvils revolve.

11. A web processing method according to claim 10, wherein:

the axis around which the pads revolve and the axis around which the anvils revolve remain set relative to each other.

* * * * *